United States Patent [19]

Raynolds et al.

[11] Patent Number: 4,595,518

[45] Date of Patent: Jun. 17, 1986

[54] COATING FIBROUS SUBSTRATES WITH FLUOROPOLYMER AMPHOTERIC POLYMER AND SURFACTANTS

[75] Inventors: Stuart Raynolds, Wilmington, Del.; Rudolph G. DiFilipantonio, Pennsville, N.J.

[73] Assignee: E. I. Du Pont de Nemours and Company, Wilmington, Del.

[21] Appl. No.: 775,105

[22] Filed: Sep. 11, 1985

Related U.S. Application Data

[63] Continuation-in-part of Ser. No. 753,301, Jul. 10, 1985, abandoned.

[51] Int. Cl.[4] ..... D06M 15/10; B05D 3/02

[52] U.S. Cl. ..... 252/8.6; 252/8.8; 252/8.9; 427/389.9; 427/393.4

[58] Field of Search ..... 427/389.9, 393.4, 393.5; 252/8.6, 8.8, 8.7

[56] References Cited

U.S. PATENT DOCUMENTS

| | | | |
|---|---|---|---|
| 3,378,609 | 4/1968 | Fasick et al. | 427/393.4 X |
| 3,462,296 | 8/1969 | Raynolds et al. | 427/393.4 X |
| 3,736,177 | 5/1973 | Buchan et al. | 427/393.4 X |
| 3,748,168 | 7/1973 | Schmidt et al. | 427/393.4 X |
| 3,816,167 | 6/1974 | Schultz et al. | 8/115.6 X |
| 3,854,871 | 12/1974 | Eanzel | 8/142 |
| 3,869,465 | 3/1975 | Waldmann | 427/393.4 X |
| 3,923,715 | 12/1975 | Dettre et al. | 428/921 X |
| 3,995,085 | 11/1976 | McCown | 428/262 |
| 4,007,305 | 2/1977 | Kakar et al. | 427/322 |
| 4,073,993 | 2/1978 | Lark | 428/261 |
| 4,107,368 | 8/1978 | Ratcliffe et al. | 428/245 |
| 4,112,153 | 9/1978 | Butterworth et al. | 427/393.4 |
| 4,132,680 | 1/1979 | Nicol | 252/547 |
| 4,145,303 | 3/1979 | Loudas | 252/156 |
| 4,279,960 | 7/1981 | Smeltz et al. | 428/290 |
| 4,346,130 | 8/1982 | Tropea | 427/393.1 |
| 4,382,990 | 5/1983 | Coates | 428/290 |

*Primary Examiner*—Thurman K. Page

[57] ABSTRACT

Process for imparting oil- and water-repellency to fibrous substrates, particularly polypropylene upholstery fabric, which comprises applying thereto an effective amount of a composition prepared by first combining one or more fluorocarbon dispersions or polyfluoroalkyl-containing polymeric latexes containing an anionic surfactant with a nonionic surfactant having an HLB of 15±3 and then with an amphoteric polymer in an amount sufficient to make the composition slightly cationic, thereby facilitating deposition of said composition to said substrate. An anionic surfactant-containing elastomeric latex may be added so as to impart abrasion resistance.

4 Claims, No Drawings

COATING FIBROUS SUBSTRATES WITH FLUOROPOLYMER AMPHOTERIC POLYMER AND SURFACTANTS

This application is a continuation-in-part of application Ser. No. 753,301 filed July 10, 1985, now abandoned.

FIELD OF THE INVENTION

The present invention relates to fluorine-containing polymeric compositions which impart durable oil- and water-repellency to fibrous substrates. It relates also to processes in which such substrates are treated so as to impart durable oil- and water-repellency to them. The invention relates further to such fibrous substrates treated with the compositions of the invention. It relates, in addition, to a manufacturing process for preparing the compositions of the invention.

BACKGROUND OF THE INVENTION

Polymers and other compounds containing highly fluorinated segments are widely used for providing oil and water repellency to textile substrates. For example, Fasik et al., in U.S. Pat. No. 3,378,609, disclose compositions which comprise a copolymer derived from at least one polyfluoroalkyl acrylate or methacrylate and at least one polymerizable vinyl compound which is free of nonvinylic fluorine, such as alkyl acrylates and methacrylates, dialkylaminoethylacrylates and methacrylates, and methylolacrylamide and methylolmethacrylamide. Also disclosed are compositions comprising a mixture of one of the foregoing polymers plus a vinyl polymer derived from at least one polymerizable compound which is free of nonvinylic fluorine or a nonfluorinated conjugated diene such as 2-chloro-1,3-butadiene or 2,3-dichloro-1,3-butadiene. U.S. Pat. No. 3,923,715 to Dettre et al. provides another example, the preferred compounds being tris(2-perfluoroalkylethyl) citrate urethanes. In some instances Dettre et al. added a nonflourinated vinyl polymer e.g. polymethylmethacrylate to an aqueous dispersion of the mixture of the perfluoroalkyl esters. Raynolds and Read, in U.S. Pat. No. 3,491,169, disclose copolymers derived from a mixture of polyfluoroalkyl methacrylates, lauryl methacrylate, hydroxyethylacrylate or hydroxyethylmethacrylate, and methylolacrylamide or methylolmethacrylamide. The latter two monomers are added in amounts of 0.5% by weight or less and serve to inhibit removal of the copolymer during laundry or dry cleaning of fabric to which the copolymer has been applied. In U.S. Pat. No. 3,462,296, Raynolds and Tandy disclose a copolymer similar to the Raynolds and Read copolymer, differing in that 2-ethylhexylmethacrylate is used in place of lauryl methacrylate and in the relative amounts of the components of the copolymers.

The prior art polymers are commonly prepared by emulsion polymerization using either an anionic or a cationic surfactant to stabilize the emulsion. The surfactant content of the dispersion or latex frequently interferes with effective deposition of the polymeric latex particles on the textile substrate which it is desired to treat. Thus, when a textile substrate is contacted with an aqueous composition containing such a latex and a cationic surfactant, a portion of the cationic surfactant migrates to and becomes deposited on the textile substrate making it cationic, thereby preventing effective deposition of the cationic polymer latex particles on the textile substrate. If the polymer latex is prepared using an anionic surfactant, a similar problem arises but for a different reason. All materials used for preparing textile fibers develop a negative charge when contacted with water. Therefore, polymeric latex or dispersion particles containing an anionic surfactant will be repelled by such fibers. The affect on deposition of latex particles on textile substrates observed with latexes containing cationic and anionic surfactants described above is referred to hereinafter as the "retarder effect." A nonionic surfactant cannot be used in the emulsion polymerization procedures in question, since they are run at temperatures which are high enough to cause a substantial portion of the nonionic surfactant to be dissolved in the organic phase, thereby causing the latex to coagulate. At those temperatures, the cationic and anionic surfactants remain in the aqueous phase, and as a consequence the latex does not coagulate.

SUMMARY OF THE INVENTION

In accordance with the present invention, the "retarder effect" is minimized by use of the composition of this invention prepared in accordance with the manufacturing process of this invention. The composition comprises one or more polymeric latexes or fluorocarbon dispersions prepared in the presence of an anionic surfactant combined with a nonionic surfactant and an amphoteric polymer. Optionally, the composition of this invention may contain an anionic elastomer latex. In accordance with the process of this invention, the nonionic surfactant is mixed with the anionic surfactant-containing polymer and/or fluorocarbon dispersion and elastomer latexes prior to addition of the amphoteric polymer.

DETAILED DESCRIPTION OF THE INVENTION

The polymer latex, or latexes, can be any polyfluoroalkyl-containing polymer latex or fluorocarbon dispersion; provided that the polymers were prepared by emulsion polymerization with the use of an anionic surfactant, or an anionic surfactant was used in preparing the fluorocarbon dispersion. Illustrative of such fluorocarbons and polymers are the fluorocarbons, polymer and mixtures of polymers disclosed in the patents discussed hereinabove, the contents of which are incorporated herein by reference. The nonionic surfactant is one having an HLB of 15±3, such as oxyethylated or oxypropylated alcohols, phenols, polyols, amines and the like, examples of which are disclosed in McCutcheon's Emulsifiers & Detergents, 1984, North American Edition, pages 299–308.

For purposes of the present invention, the amphoteric polymer is defined as one which will cause a latex or a dispersion having an anionic zeta potential to become cationic as a result of its being added to the dispersion and as a result of adjustment of the pH to one that is slightly more acidic than that at which the isoelectric point of the dispersion occurs. Usually it is sufficient to change the pH by one pH unit, e.g., change pH 7 to pH 6. One uses a quantity of the amphoteric polymer which is sufficient with pH adjustment to cause the zeta potential to be adjusted from strongly anionic through 0 to mildly cationic, e.g., +15 to +30 millivolts. Generally it is sufficient to add between 7 and 50% by weight of the amphoteric polymer, based upon the weight of solids in the anionic disperion or latex. Exemplary of the amphoteric polymers are copolymers of dialkylaminoalkyl acrylates or methacrylates with or without alkyl acrylates and/or methacrylates with or without acrylic or methacrylic acid with or without fluoroacrylates or fluoromethacrylates. Glycidyl acrylates or methacrylates can be used in such copolymers as can 3-chloro-2-hydroxypropyl acrylate or methacrylate. The dialkylaminoalkyl acrylate or methacrylate can be used as such or in the form of an acid salt or an N-oxide or a betaine.

In accordance with the manufacturing process of the invention, it is essential that the nonionic surfactant be combined with all anionic components of the composition of the invention prior to addition of the amphoteric polymer. If the amphoteric polymer were added to the anionic components of the composition in the absence of an effective amount of the nonionic surfactant, coagulation of the latex or dispersion would occur as the amphoteric polymer causes the zeta potential to go from negative to positive. Thus, one can combine all components of the composition other than the amphoteric polymer in whatever order one chooses, so long as the nonionic surfactant is combined with all anionic components prior to the addition of the amphoteric polymer. In a preferred embodiment, the composition of the invention is used to impart oil- and water-repellency to upholstery fabric, particularly that made from polypropylene fibers. In that embodiment, one uses an abrasion-resistant material such as polychloroprene in the form of an anionic latex.

In accordance with the process for using the composition of the invention, one imparts oil- and water-repellency to fibrous substrates by applying to the substrate an effective amount of the composition of the invention. In that process, one first combines one or more fluorocarbon dispersions and/or polyfluoroalkyl-containing polymeric latexes containing an anionic surfactant with a nonionic surfactant having an HLB of 15±3. Thereafter an amphoteric polymer is added in an amount sufficient to make the composition slightly cationic, thereby facilitating deposition of the composition to the substrate.

In an embodiment of the composition, particularly appropriate for imparting oil- and water-repellency to nylon, polyolefin and acrylic upholstery fabrics, a mixture of various anionic fluorocarbon dispersions and/or polymeric latexes were used along with an anionic polychloroprene latex. That type of composition is illustrated by the examples given herein.

Zeta Potential

Zeta potentials of the aqueous latexes or dispersions were measured using a Zeta Meter. The rate of movement of the colloid particles in an electric field is measured by direct observation using a steroscopic microscope and reflected-beam illumination. The method, described in detail in Zeta-Meter Manual, 2nd Edition, Zeta-Meter, Inc., New York, is suitable for particles larger than about 0.1–0.2 micron in diameter. Since many of the product baths studied in the present invention contain particles smaller than 0.1 micron, it has been assumed that the zeta potential determined from tracking the larger particles is representative of the entire size range of particles in the baths. In order to eliminate the effects of thermal changes which influence the movement of the particles in the Zeta-Meter cell, the particles were tracked in both directions by reversing the polarity of the cell. At least 100 particles were tracked for each zeta potential determination.

Oil-Repellency Test (Adapted From AATCC Test Method 118)

A piece of fabric, treated with an aqueous dispersion of the polymers of this invention, is conditioned for a minimum of 2 hours at 23°±2° and 65±10% relative humidity. The repellency of carpet samples should be measured on the side of the yarn, not on the tips of the tufts. Beginning with the lowest numbered test liquid (Repellency Rating No. 1), one drop (approximately 5 mm diameter or 0.05-ml volume) is placed on each of three locations at least 5 mm apart. The drops are observed for 30 seconds. If, at the end of that period of time, two of the three drops are still spherical to hemispherical in shape with no wicking around the drops, three drops of the next higher numbered test liquid are placed on adjacent sites and observed again for 30 seconds. The procedure is continued until one of the test liquids results in two of the three drops failing to remain spherical or hemispherical, or wetting or wicking occurs. The oil-repellency rating of the yarn or fabric is the highest numbered test liquid for which two or three drops remain spherical or hemispherical with no wicking for 30 seconds.

STANDARD OIL TEST LIQUIDS

| Oil-Repellency Rating Number | Composition |
|---|---|
| 1 | "Nujol"* |
| 2 | 65/35 "Nujol"/n-hexadecane by volume at 21° |
| 3 | n-hexadecane |
| 4 | n-tetradecane |
| 5 | n-dodecane |
| 6 | n-decane |

*"Nujol" is the trademark of Plough, Inc., for a mineral oil which has a Saybolt viscosity of 360/390 at 38° and a specific gravity of 0.880/0.900 at 15°.

Water-Repellency Test

A piece of fabric, treated with an aqueous dispersion or latex of the composition of this invention, is conditioned for a minimum of two hours at 21°±1° C. and 65±2% relative humidity. The fabric test specimen is so positioned that the area to be tested is flat and horizontal. Beginning with the lowest numbered test liquid (Water Repellency Rating No. 1), one drop (approximately 5 mm in diameter or 0.05-ml. in volume) is placed on each of three locations at least 5 cm apart. Care should be taken to avoid placing the test liquid on the same sites as those used for the oil-repellency ratings. If, after ten seconds, two of the three drops are still visible as spherical to hemispherical, place three drops of the next higher numbered test liquid on an adjacent site and observe for ten seconds. Continue the procedure until one of the test liquids results in two of the three drops failing to remain spherical or hemispherical. The water repellency rating of the fabric is the highest numbered test liquid for which two of three drops remain spherical or hemispherical for at least ten seconds.

Standard Water Test Solutions

| Water Repellency Rating Number | Composition: % Isopropanol* | Composition: % Distilled $H_2O$ | Flash Point (TCC) °C. | Flash Point (TCC) °F. |
|---|---|---|---|---|
| 1 | 2 | 98 | — | — |
| 2 | 5 | 95 | 50 | 122 |

-continued

| Water Repellency Rating Number | Standard Water Test Solutions Composition % Isopropanol* | % Distilled $H_2O$ | Flash Point (TCC) ° C. | ° F. |
|---|---|---|---|---|
| 3 | 10 | 90 | 40 | 104 |
| 4 | 20 | 80 | 28 | 82 |
| 5 | 30 | 70 | 19 | 66 |

*Reagent Grade, percentage by volume, available from Merck, Inc., Rahway, N.J.

Abrasion Test Method

Resistance of the upholstery fabric to abrasion is determined by the Dry Crocking Test method set forth in AATCC Test Method 8-1981.

The following examples are illustrative of the invention. Unless otherwise indicated, all parts and percentages are by weight and temperatures are in degrees Celsius. In describing the polymers prepared hereinbelow, the percentages of monomer units given for the polymers are based on the weights of monomers charged to the reaction.

TYPICAL PREPARATIONS OF COMPONENTS FOR PREFERRED EMBODIMENT

Dispersion I

A mixture of 2-perfluoroalkylethanols was used to prepare a mixture of tris(2-perfluoroalkylethyl) citrates. The mixture of 2-perfluoroalkylethanols is such that in their perfluoroalkyl groups, $CF_3CF_2(CF_2)_k$, k is 2, 4, 6, 8, 10, 12 and 14 in the approximate weight ratio of 1/33/31/18/8/3/1, and such a mixture has an average molecular weight of about 452. The 2-perfluoroalkylethanol (4306 kg) was combined with agitation at 70°±5° with anhydrous citric acid (562 kg). Thereafter granular boric acid (2.7 kg) and aqueous phosphorous acid (6.4 kg of a 70% solution) were added as catalysts. The temperature of the reaction mixture was increased over a 3–4 hours period to 130°±5° with agitation. Agitation was continued for 23–24 hours while removing water formed in the reaction between the 2-perfluoroalkylethanol and citric acid. When analysis indicated that the esterification was complete, the temperature of the reaction was reduced to 70–80° and butyltintrichloride (5.9 kg) was added. The temperature was adjusted to 70°–75° and hexamethylene diisocyanate (255 kg) was added. The temperature was allowed to rise to 80°–86° and held at that temperature for about 6 hours. Thereafter the temperature was increased to 92°±2° and the reaction mixture agitated at that temperature for 8 hours. The reaction temperature was then reduced to 55°–75° C. and methylisobutylketone (2312 kg) was added to it. The reaction temperature was adjusted to 60°–70° and the mixture was agitated for 1–2 hours. The product was a solution of the tris(2-perfluoroalkylethyl) citrate urethane in methylisobutylketone having a weight of 7003 kg which contained 4392 kg of a mixture of tris(2-perfluoroalkylethyl) citrate urethanes.

A mixture of tris(2-perfluoroalkylethyl) citrate urethanes (851 kg) dissolved in methylisobutylketone (419 kg) prepared in the manner described above was emulsified with deionized water (1419 kg) and aqueous sodium dodecylbenzene sulfonate (85 kg of a 30% solution). The methylisobutylketone was then removed from the emulsion by vacuum distillation. The resulting dispersion was standardized to 40±1.5% of the citrate urethane, using deionized water.

Latex I

The mixture of fluoromonomers used in this procedure were those having the following formula $$CF_3CF_2(CF_2)_kCH_2CH_2OC(O)C(CH_3)=CH_2$$

in which k has the same values and distribution given above and the mixture of fluoromonomers has an average molecular weight of 520.

Deionized water (515 kg) was combined with agitation with aqueous sodium dodecylbenzene sulfonate (210 kg of a 30% slurry). Agitation was continued for 10–15 minutes at 45°±5°. The above-described mixture of fluoromonomers (816 kg) was combined in a separate vessel with 2-ethylhexylmethacrylate (272 kg) and agitated for 10 minutes at 45°±5°, whereupon the combination of the fluoromonomer mixture and the 2-ethylhexylmethacrylate (2-EHMA) was added to the mixture of deionized water and the sodium dodecylbenzene sulfonate. The resulting charge was homogenized. The homogenizer was rinsed with deionized water (363 kg), and the rinse water was added to the homogenized emulsion. In a separate vessel, primary dodecyl mercaptan (545 g), hydroxyethylmethacrylate (2.7 kg, 94% purity) and aqueous N-methylolacrylamide (5.7 kg of a 48% solution) were mixed at ambient temperature, and thereafter combined with agitation for 5–10 minutes with the above-described homogenized emulsion. The resulting charge was then combined with deionized water (1451 kg), and that charge was agitated for at least 30 minutes at 65°±2°. Then azobisisobutyramidine dihydrochloride (436 g) dissolved in deionized water (2-3 quarts) was added and with agitation polymerization of the charge proceeded with the temperature being maintained at 70°±2° for 4 hours. Thereafter the charge was cooled to 30°–35° . The final product weighed 3606 kg, 1021 kg of which constituted the polymer.

Latex II

The mixture of fluoromonomers used in this preparation was essentially the same as that used in Latex I.

Deionized water (333 kg) was mixed with agitation at 50°–55° with aqueous sodium lauryl sulfate (37.6±0.5 kg of a 30% solution). In a separate vessel, the mixture of fluoromonomers (358±3 kg) was combined with lauryl methacrylate (193±1.8 kg), the resulting charge being mixed well by agitation for 5–10 minutes. Then the combined monomers were mixed with agitation with the solution of sodium lauryl sulfate, following which it was homogenized. After homogenization was complete, the equipment used for homogenization was rinsed with demineralized water (182 kg), and the rinse water added to the homogenized dispersion. Thereafter, lauryl mercaptan (891±9 g) and N-methylolacrylamide (2.31±0.05 kg) were added to the homogenized dispersion of monomers. The resulting charge was added to demineralized water (737 kg) at 80°–85° . The temperature was adjusted to 65°±1° and agitation of the charge was continued for 30 minutes. N,N'-azobisisobutyramidine dihydrochloride 218±2 g) dissolved in about one half gallon of water. With agitation polymerization proceeded at 70°±1°, which temperature was maintained for a period of 4 hours. The resulting polymeric product was cooled to 30°–40° C. and sufficient deionized water (about 547 kg) was added to it to bring its solids content to 22.5%.

Polymer I

In contrast to the emulsion polymerization procedures described above, Polymer I was prepared by solution polymerization.

Deionized water (615 kg) and 2-dimethylaminoethyl methacrylate (250 kg) were combined with agitation at 20°. Glacial acetic acid (95 kg) was added to that mixture and agitated for 10–15 minutes, and acrylic acid (57 kg) was added thereto. The foregoing charge was combined with a mixture of deionized water (461 kg) and isopropyl alcohol (461 kg) over a period of 15–20 minutes. The temperature of the charge was adjusted to 65°–2° and agitation was continued for 30 minutes. At that point 2,2'-azobisisobutyramidine dihydrochloride (409 g) dissolved in deionized water (3.8 kg) was added. Polymerization proceded with agitation at 70 ±2° for 18 hours. With the charge temperature at 70°, deionized water (923 kg) was added to the polymerization charge over a period of 30±5 minutes.

Latex III

A commercially available copolymer of chloroprene and 2,3-dichloro1,3-butadiene (Du Pont Neoprene Latex 400) was used. The latex contained 50% by weight solids and had a pH of 12.5 at 25°, a specific gravity of 1.15 at 25°, an average particle size of 0.12 microns, a surface tension of 37.1 dyenes/cm, and a Brookfield Viscosity of 9 cp. The commercial latex was diluted with deionized water to a solids content of 6% and it was neutralized to a pH of 6.3 with 10% acetic acid.

EXAMPLE 1

Dispersion I (575 parts), Latex I (576 parts) and Latex II (400 parts) were mixed with slow agitation at ambient temperature, and aqueous ethoxylated sorbitan monooleate containing 20 ethylene oxide units (580 parts of a 20% solution, Tween 80) was added with agitation. Latex III was added with agitation over a 1–1.5 hour period, and then Polymer I was added with agitation over an additional 1–1.5 hour period. The resulting blend was neutralized to a pH of 6.5–6.9 with triethanolamine. Zeta potential measurement was made on an aqueous dilution of the product containing 2.15% of the final blend to give a zeta potential between +20 and +28 millivolts.

Polypropylene fabric was treated with the final product blend by pad application to provide 2% of the blend based on the weight of the fabric. When tested for oil-repellency, it gave a rating of 8, and when tested for water-repellency, it gave a rating of 5. After 10 cycles of cotton abrasion, the oil repellency was 2–3.

EXAMPLE 2

Example 1 was repeated substituting for Polymer I a solution polymer (900 parts) of 75 parts of butylmethacrylate and 25 parts of diethylaminoethylmethacrylate N-oxide. The resulting latex product was applied by spray application to polypropylene fabric at a level of 2% of the latex based on the weight of the fabric to give an oil-repellency rating of 5+and a water-repellency rating of 4.

EXAMPLE 3

Example 1 was repeated substituting for Polymer I thereof a solution polymer (900 parts) of dimethylaminoethylmethacrylate/methylmethacrylate/acrylic acid at a 2/1/1 mol ratio. When the resulting latex was applied by spray application to polypropylene fabric at a 2% level, it gave an oil-repellency rating of 6 and a water-repellency rating of 4.

EXAMPLE 4

Example 1 was repeated substituting for Polymer I thereof a solution polymer (1220 parts) of diethylaminoethylmethacrylate/methylmethacrylate/ acrylic acid at a 2/1/1 mol ratio. When applied to polypropylene fabric at a 2% level, it gave an oil-repellency rating of 5+and a water-repellency rating of 4.

EXAMPLE 5

Example 1 was repeated substituting for Polymer I thereof a solution polymer (1220 parts) of dimethylaminoethylmethacrylate/methylmethacrylate/ acrylic acid/butylacrylate at a mol ratio of 1.9/1/1/0.1. When applied by spray application to polypropylene fabric at a level of 2% on the weight of the fabric, it gave an oil-repellency rating of 6 and a water-repellency rating of 5.

EXAMPLE 6

Example 1 was repeated substituting for Polymer I thereof a solution polymer (900 parts) of 75 parts of 2-ethylhexylmethacrylate and 25 parts of diethylaminoethylmethacrylate N-oxide. When applied to polypropylene fabric by spray application at a level of 2% on the weight of the fabric, it gave an oil-repellency rating of 5+and a water-repellency rating of 4.

EXAMPLE 7

Example 1 was repeated substituting for Polymer I thereof a solution polymer (1035 parts) of 85 parts methylmethacrylate and 15 parts of diethylaminoethylmethacrylate.acetate. When applied to polypropylene fabric by spray application at a 2% level, it gave an oil-repellency rating of 4 and a water-repellency rating of 5.

EXAMPLE 8

Example 1 was repeated substituting for Polymer I thereof a solution polymer (900 parts) containing 90 parts of butylmethacrylate, 8 parts of dimethylaminoethylmethacrylate and 2 parts by weight acrylic acid. When applied by spray application to polypropylene fabric at a level of 2% based on the weight of the fabric, it gave an oil-repellency rating of 5 and a water-repellency rating of 5.

EXAMPLES 9–40

The procedure of the foregoing examples was repeated giving similar results with the following solution amphoteric polymers being substituted for Polymer I. The mixture of fluoromonomer (FM) was essentially that of Example 1.

| Amphoteric Polymers | |
|---|---|
| Monomers | Weight Ratio (Mol Ratio) |
| 9. Butyl Acrylate (BA)/Acrylic Acid (AA)/Dimethylaminoethyl methacrylate (DMAM) | 97.5/0.5/2 |
| 10. FM/Ethyl Acrylate (EA)/AA/DMAM | 75/25/0.1/0.1 |
| 11. FM/BA/Diethylaminoethyl methacrylate $CH_3Cl$ quaternary | 75/25/0.1 |
| 12. FM/BA/DMAM/AA | 75/23/1.85/0.4 |

-continued

| Amphoteric Polymers | |
|---|---|
| Monomers | Weight Ratio (Mol Ratio) |
| 13. FM/BA/DMAM.$(CH_3)_2SO_4$ Quaternary | 75/25/0.1 |
| 14. FM/EA/DMAM/AA | 83/10/4/3 |
| 15. FM/BA/3-Chloro-2-hydroxypropyl methacrylate (CHPM)/DMAM/AA | 60/15/20/4/1 |
| 16. FM/BA/Glycidylmethacrylate/ DMAM/AA | 60/15/20/4/1 |
| 17. DEAM/Methylmethacrylate (MMA)/AA | (3/1/1) |
| 18. DEAM/MMA/AA | (1/1/3) |
| 19. DEAM/MMA/AA | (2/1/1) |
| 20. DEAM/MMA/AA | (1/1/2) |
| 21. DEAM/MMA/AA | (2/4/1) |
| 22. FM/DEAM.Carboxylmethyl-betaine | 75/25 |
| 23. DMAM/MMA/AA | (1/1/1.5) |
| 24. DMAM/MMA/AA | (1/1/2) |
| 25. FM/DMAM/AA | (0.65/1.8/1) |
| 26. DEAM.N → O | — |
| 27. DEAM/2-Acrylamido-2-Propane Sulfonic Acid (AMPS) | (1/1) |
| 28. MMA/DEAM.Acetate | 75/25 |
| 29. MMA/DEAM/AMPS | 73/13/14 |
| 30. Butylmethacrylate/DEAM.Acetate | 75/25 |
| 31. FM/DEAM.Acetate | 85/15 |
| 32. MMA/DEAM.$(CH_3)_2SO_4$ Quaternary | 65/35 |
| 33. MMA/CHPM/DEAM.$(CH_3)_2SO_4$ Quaternary | 40/25/35 |
| 34. $R_fCH_2CH_2SCH_2CH_2COO^{(-)}NH_4^{(+)}$ ($R_f$ = essentially same $CF_2$ distribution as FM) | — |
| 35. DEAM/Hydroxyethylmethacrylate/AA | (2/1/1) |
| 36. 2-EHMA/MMA/DEAM.N → O | 37.5/37.5/25 |
| 37. 2-EHMA/MMA/DEAM.N → O | 56.75/18.75/25 |
| 38. CHPM/DEAM.N → O | 75/25 |
| 39. DMAM/MMA/β-Carboxyethylacrylate (β-CEA) | (2/1/1) |
| 40. DMAM/MMA/β-CEA/BA | (2/1/1/0.1) |

We claim:

1. A process for imparting oil- and water-repellency to a fibrous substrate which comprises applying thereto an effective amount of a composition prepared by first combining one or more fluorocarbon dispersions or polyfluoroalkyl-containing polymeric latexes containing an anionic surfactant with a nonionic an HLB of 15±3 and then with an amphoteric polymer in an amount sufficient to make the composition slightly cationic, thereby facilitating deposition of said composition to said substrate.

2. The process of claim 1 wherein substrate in said fabric is polypropylene.

3. The process of claim 2 wherein said polypropylene fabric is an upholstery fabric.

4. The process of claim 3 wherein said composition is prepared by combining said polyfluoroalkyl-containing latexes or dispersion with said nonionic surfactant and an anionic surfactant-containing elastomeric latex prior to adding said amphoteric polymer thereto.

* * * * *

UNITED STATES PATENT OFFICE
CERTIFICATE OF CORRECTION

PATENT NO. : 4,595,518

DATED : June 17, 1986

INVENTOR(S) : Stuart Raynolds; Rudolph G. DiFilipantonio

It is certified that error appears in the above-identified patent and that said Letters Patent are hereby corrected as shown below:

In Claim 1, column 10, line 20, between "nonionic" and "an" insert --surfactant having--.

Signed and Sealed this

*Twenty-sixth* Day of *August 1986*

[SEAL]

*Attest:*

DONALD J. QUIGG

*Attesting Officer*

*Commissioner of Patents and Trademarks*